US010247133B2

(12) United States Patent
Muscas

(10) Patent No.: US 10,247,133 B2
(45) Date of Patent: Apr. 2, 2019

(54) PISTON WITH COOLING GALLERY RADIATOR AND METHOD OF CONSTRUCTION THEREOF

(71) Applicant: FEDERAL-MOGUL CORPORATION, Southfield, MI (US)

(72) Inventor: Nicolae Muscas, Troy, MI (US)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 15/412,457

(22) Filed: Jan. 23, 2017

(65) Prior Publication Data

US 2017/0211459 A1 Jul. 27, 2017

Related U.S. Application Data

(60) Provisional application No. 62/286,842, filed on Jan. 25, 2016.

(51) Int. Cl.
*F01P 3/22* (2006.01)
*F02F 3/20* (2006.01)
(Continued)

(52) U.S. Cl.
CPC ..... *F02F 3/20* (2013.01); *F02F 3/0076* (2013.01); *F02F 3/02* (2013.01); *F02F 3/22* (2013.01);
(Continued)

(58) Field of Classification Search
CPC ..... F01P 3/10; F02F 3/22; F02F 3/02; F02F 3/20; F02F 3/0076; F02F 2003/0061; F02F 2200/00
See application file for complete search history.

(56) References Cited

U.S. PATENT DOCUMENTS 1,292,882 A 1/1919 Riedler
2,437,824 A 3/1948 Kishline
(Continued)

FOREIGN PATENT DOCUMENTS

DE 102011115826 A1 4/2013
GB 1226334 A * 3/1971 ..... F02F 3/22
(Continued)

OTHER PUBLICATIONS

International Search Report, dated May 9, 2017 (PCT/US2017/014643).

*Primary Examiner* — Jacob Amick
*Assistant Examiner* — Charles Brauch
(74) *Attorney, Agent, or Firm* — Robert L. Stearns; Dickinson Wright, PLLC

(57) ABSTRACT

A piston with a cooling gallery containing an open cell radiator is provided. The radiator has a large thermally conductive surface area that acts as a heat-sink to remove heat from the piston. Heat from the piston is transmitted from the radiator to cooling oil that enters the cooling gallery via an oil inlet formed in a floor of the cooling gallery and exits the cooling gallery via an oil outlet. The piston comprises a piston body including an upper part presenting an upper combustion surface and an undercrown surface. A ring belt depends from the upper combustion surface, and the cooling gallery extends around the piston body beneath the undercrown surface radially inwardly of the ring belt. The radiator includes a plurality of fins extending annularly around the cooling gallery. The fins of the radiator are spaced from one another by gaps extending annularly around the cooling gallery.

20 Claims, 5 Drawing Sheets

(51) Int. Cl.
*F02F 3/00* (2006.01)
*F02F 3/02* (2006.01)
*F02F 3/22* (2006.01)

(52) U.S. Cl.
CPC ..... *F01P 3/22* (2013.01); *F02F 2003/0061* (2013.01); *F02F 2200/00* (2013.01)

(56) References Cited

U.S. PATENT DOCUMENTS

| | | | | |
|---|---|---|---|---|
| 2,449,657 | A | 9/1948 | Kishline | |
| 6,659,062 | B1 | 12/2003 | Issler | |
| 8,714,129 | B2 * | 5/2014 | Bauer | F02F 3/0023 123/193.6 |
| 2012/0304956 | A1 * | 12/2012 | Wang | F02F 3/003 123/193.6 |
| 2013/0098316 | A1 * | 4/2013 | Stan | F02F 3/003 123/41.35 |
| 2013/0104838 | A1 * | 5/2013 | Spangenberg | F02F 3/16 123/193.6 |
| 2014/0102294 | A1 * | 4/2014 | Klein | F02F 3/22 92/208 |

FOREIGN PATENT DOCUMENTS

| | | | |
|---|---|---|---|
| JP | H05288049 | A | 11/1993 |
| JP | H1182738 | A | 3/1999 |

* cited by examiner

PISTON WITH COOLING GALLERY RADIATOR AND METHOD OF CONSTRUCTION THEREOF

CROSS-REFERENCE TO RELATED APPLICATION

This U.S. utility patent application claims the benefit of U.S. provisional patent application No. 62/286,842, filed Jan. 25, 2016, the entire contents of which are incorporated herein by reference.

BACKGROUND OF THE INVENTION

1. Technical Field

This invention relates generally to internal combustion engines, and more particularly to pistons and their method of construction.

2. Related Art

Engine manufacturers are encountering increasing demands to improve engine efficiencies and performance, including, but not limited to, improving fuel economy, improving fuel combustion, reducing oil consumption, and increasing the exhaust temperature for subsequent use of the heat within the vehicle. In order to achieve these goals, the engine running temperature in the combustion chamber needs to be increased. However, while desirable to increase the temperature within the combustion chamber, it remains necessary to maintain the piston at a workable temperature. As such, it is known to form an outer annular cooling gallery within the piston head, through which engine oil is circulated to reduce the operating temperature of the piston head. However, although effective at reducing the operating temperature of the piston head, further advancements are needed to account for the ever increasing temperatures within high performance combustion chambers, which ultimately effect the ability of known outer cooling galleries to maintain the piston head at desired operating temperatures.

SUMMARY OF THE INVENTION

A piston capable of being maintained at a reduced, desired operating temperature within modern high performance combustion engines is provided. The piston includes a piston body including an upper part presenting an upper combustion surface and an undercrown surface beneath the upper combustion surface. A cooling gallery extends around the piston body beneath the undercrown surface. A radiator is disposed in the cooling gallery, and the radiator includes a plurality of fins extending annularly around the cooling gallery. The fins of the radiator are spaced from one another by gaps extending annularly around the cooling gallery.

A method of manufacturing a piston capable of being maintained at a reduced, desired operating temperature within modern high performance combustion engines is also provided. The method includes providing a piston body including an upper part and a lower part, the upper part having an upper combustion surface and an undercrown surface beneath the upper combustion surface, and the piston body including a cooling gallery extending annularly around the piston body beneath the undercrown surface. The method next includes disposing a radiator in the cooling gallery, the radiator includes a plurality of fins extending annularly around the cooling gallery which are spaced from one another by air gaps extending annularly around the cooling gallery.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF EXEMPLARY EMBODIMENTS

Figure 1A:
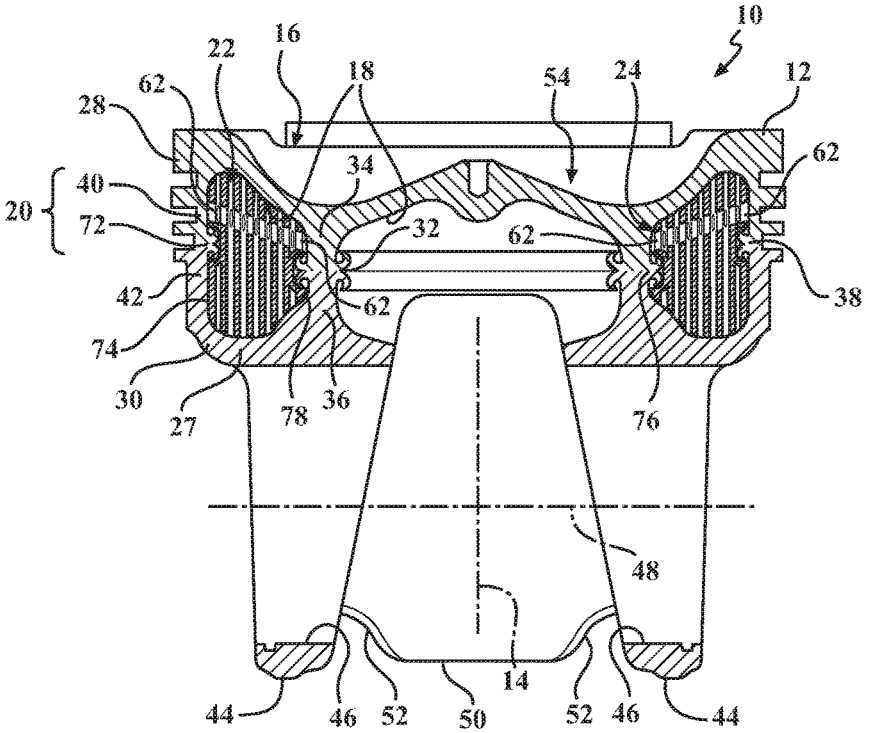
FIG. 1A is a cross-sectional side view taken generally along a pin bore axis of a piston constructed in accordance with one aspect of the invention.
Figure 1B:
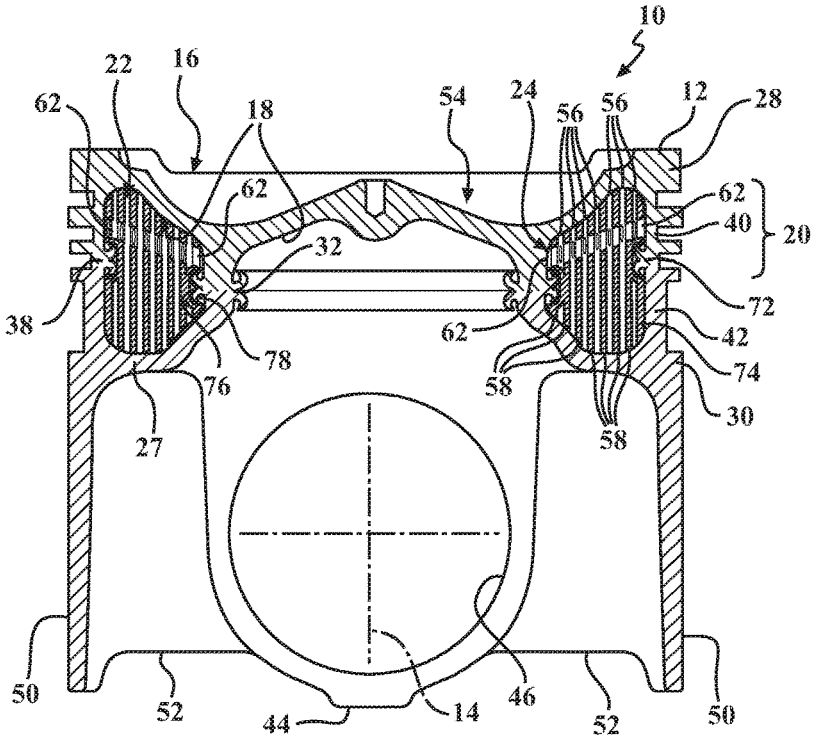
FIG. 1B is a view similar to FIG. 1A taken generally transversely to the pin bore axis.
Figure 1C:
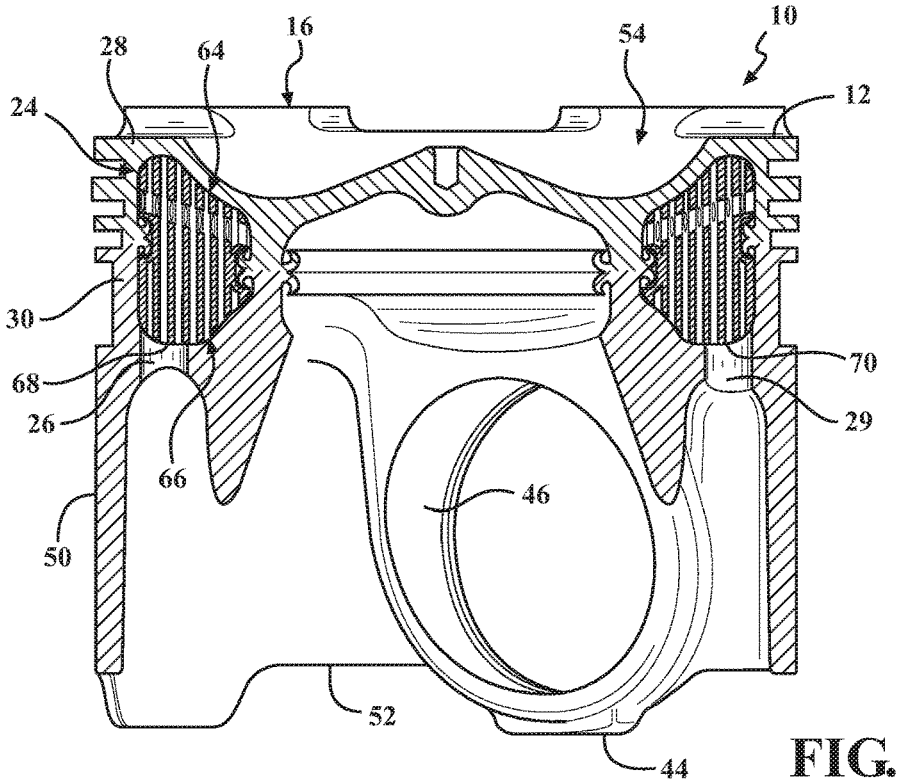
FIG. 1C is a view similar to FIG. 1A taken along a line oblique to the pin bore axis.
Figure 2A:
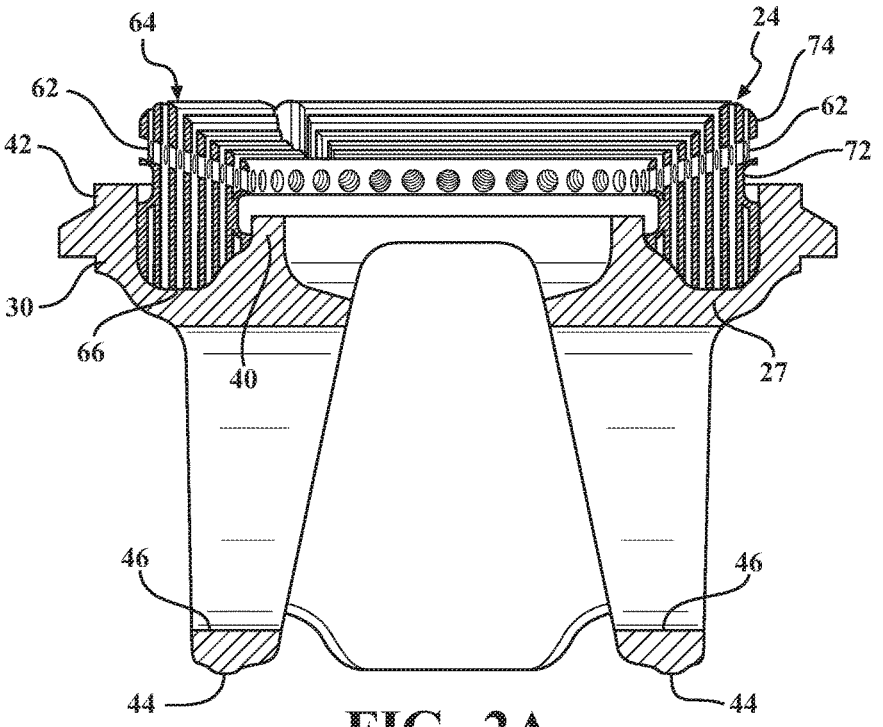
FIG. 2A is a view similar to FIG. 1A shown prior to fixing an upper part to the piston.
Figure 2B:
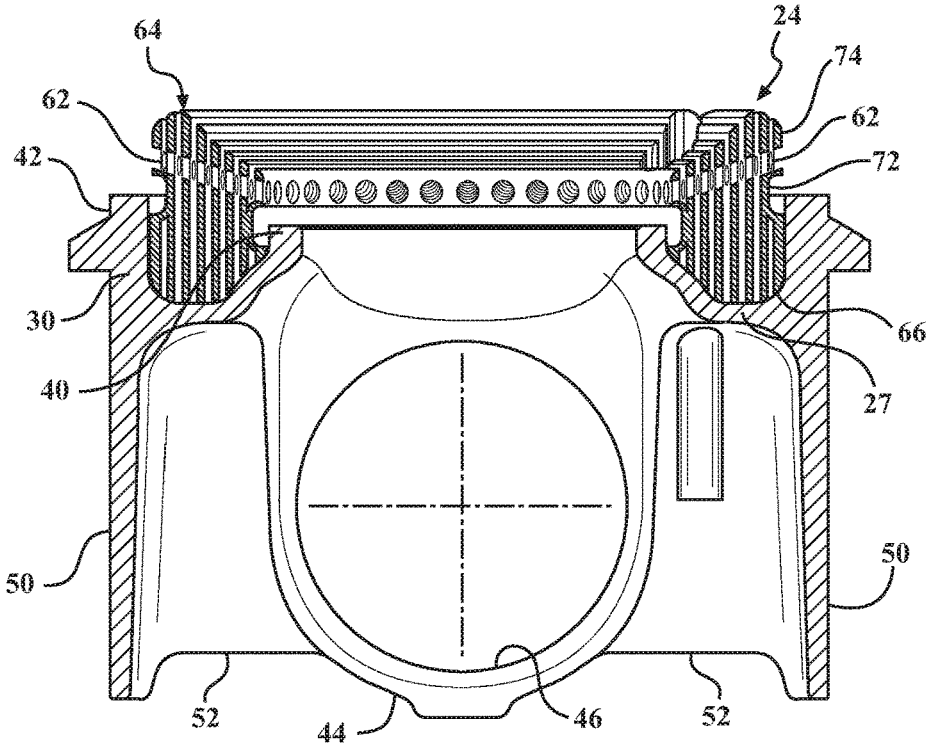
FIG. 2B is a view similar to FIG. 1B shown prior to fixing an upper part to the piston.
Figure 2C:
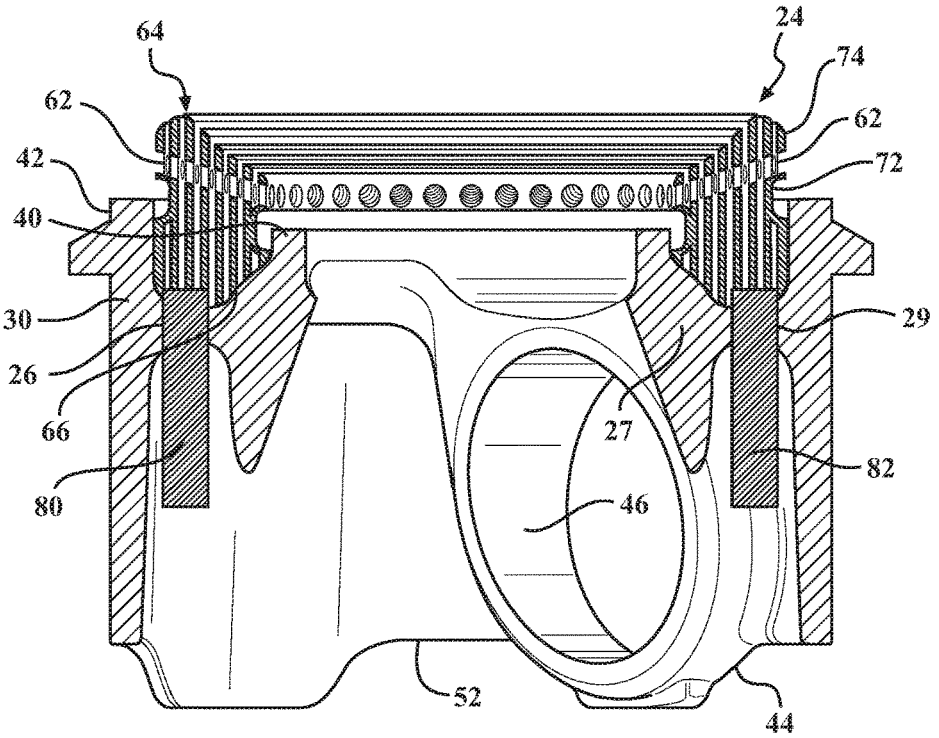
FIG. 2C is a view similar to FIG. 1C shown prior to fixing an upper part to the piston.

Referring in more detail to the drawings, FIGS. 1A-1C illustrate a piston assembly, referred to hereafter simply as piston 10, constructed according to one presently preferred embodiment of the invention, for reciprocating movement in a cylinder bore or chamber of an internal combustion engine (not shown), such as light vehicle diesel, mid-range diesel, heavy duty and large bore diesel engines, and gas engines, for example. The piston 10 has a piston body 12 extending along a central longitudinal axis 14 along which the piston 10 reciprocates in the cylinder bore. The body 12 is formed with an upper combustion wall having on one side an upper combustion surface 16 configured for direct exposure to combustion gases within a cylinder bore and on an opposite side an undercrown surface 18 located directly and axially beneath the upper combustion surface 16. The piston body 12 is also formed with a ring belt 20 adjacent the upper combustion surface 16 and depending from the upper combustion surface 16. The ring belt 20 is configured for receipt of at least one piston ring (not shown). Further, the piston body 12 is constructed having a substantially closed cooling gallery 22 extending annularly around the piston body 12, shown as being located beneath and along the undercrown surface 18 and radially inwardly and in substantial radial alignment with the ring belt 20, by way of example and without limitation.

The cooling gallery 22 has an open cell radiator 24 disposed therein, wherein the radiator 24 has a large thermally conductive surface area that acts as a heat-sink to remove heat from the piston 10. Heat from the piston body 12 is then transmitted to cooling oil that enters the cooling gallery 22 via an oil inlet 26 formed in a floor 27 of the cooling gallery 22 and exits the cooling gallery 22 via an oil outlet 29, and thus, from surrounding areas of the piston 10, thereby enhancing the cooling efficiency of the cooling oil.

The piston body 12 is shown having a steel upper part 28 and a steel lower part 30 presenting the cooling gallery 22 therebetween. The lower part 30 extends along the central axis 14 and depends from the upper part 28. In the example embodiment, the upper part 28 presents the upper combustion surface 16, an undercrown surface 28, and an upper portion of the cooling gallery 22. The lower part 30 presents a lower portion of the cooling gallery 22. The upper part 28 and the lower part 30 of the piston body 12 are typically constructed from separate pieces of steel material and subsequently fixed to one another via a welding process, such as induction welding, resistance welding, charge carrier rays, electron beam welding, laser welding, stir welding, brazing, soldering, hot or cold diffusion, or other joining process, and illustrated as a friction welding process, thereby resulting in an annular flashing being formed at the friction bond joints.

In the embodiment shown, the upper part 28 includes an upper inner rib 34 dependent from the undercrown surface 18 and an upper outer rib 40 spaced from the upper inner rib 34 and forming a portion of the ring belt 20. The lower part 30 includes a lower inner rib 36 extending upwardly from the floor 27 and a lower outer rib 42 spaced from the lower inner rib 36 and forming a portion of the ring belt 20. The floor 27 extends between the lower ribs 36, 42. Also in the embodiment shown, a first bond joint 32 joins the pair of annular inner ribs 34, 36 to one another, and a second bond joint 38 extends through the ring belt 20 to join the pair of annular outer ribs 40, 42 to one another.

The lower part 30 depends along the central axis 14 from the upper part 28 to provide a pair of pin bosses 44 having laterally spaced pin bores 46 coaxially aligned along a pin bore axis 48. The pin bore axis 48 extends generally transverse to the central longitudinal axis 14. The pin bosses 44 are joined to laterally spaced skirt portions 50 via strut portions 52. The skirt portions 50 are diametrically spaced from one another across opposite sides of the pin bore axis 48 and have convex outer surfaces contoured for sliding cooperation within the cylinder bore to maintain the piston 10 in a desired orientation as it reciprocates through the cylinder bore.

The upper combustion surface 16 is represented as having a recessed combustion bowl 54 to provide a desired gas flow with the cylinder bore. At least in part due to the combustion bowl 54, relatively thin regions of material of the piston body 12 are formed between the upper combustion surface 16, the cooling gallery 22, and the undercrown surface 18. As such, in use, these regions need to be properly cooled via relatively cool oil flowing through the cooling gallery 22. In accordance with one aspect of the invention, the necessary cooling for the piston body 12 is provided, at least in part, via the radiator 24 disposed in the cooling gallery 22 and the cooling oil flowing through the radiator 24.

The radiator 24 is typically constructed of a separate component and from a piece of thermally conductive metal material from the piston body 12, and can be constructed as a single piece of material, if desired. It is contemplated herein that the radiator 24 could be constructed of a plurality of separate pieces of material, though it is believed more efficient in manufacture and assembly to construct the radiator 24 as a monolithic piece of material, such as from any suitably thermally conductive material, including aluminum, which is believed to the be most cost effective material, or copper, which is believed to be the most thermally conductive material, but more costly, and of course, other materials may include steel, though it would come at an increased weight relative to aluminum. The aforementioned materials are not intended to be an exhaustive listing of potential materials, as one skilled in the art would readily recognize others.

Figure 3A:
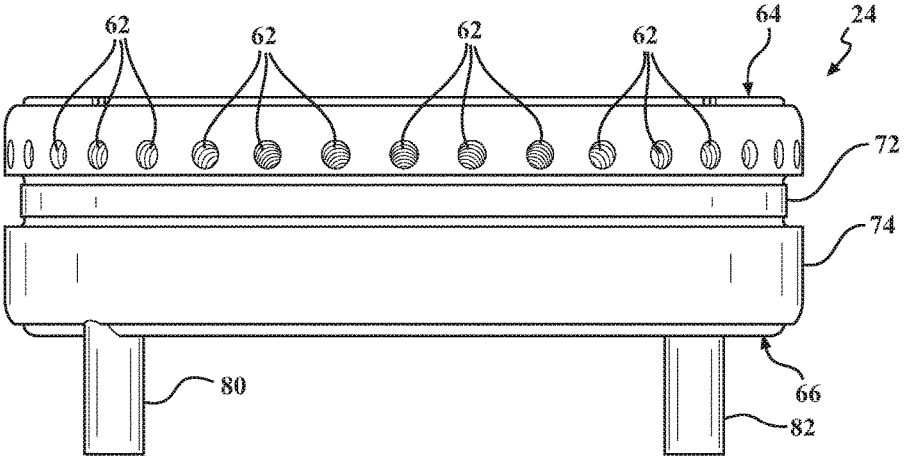
FIG. 3A is side view of a radiator of the piston of FIGS. 1 and 2.
Figure 3B:
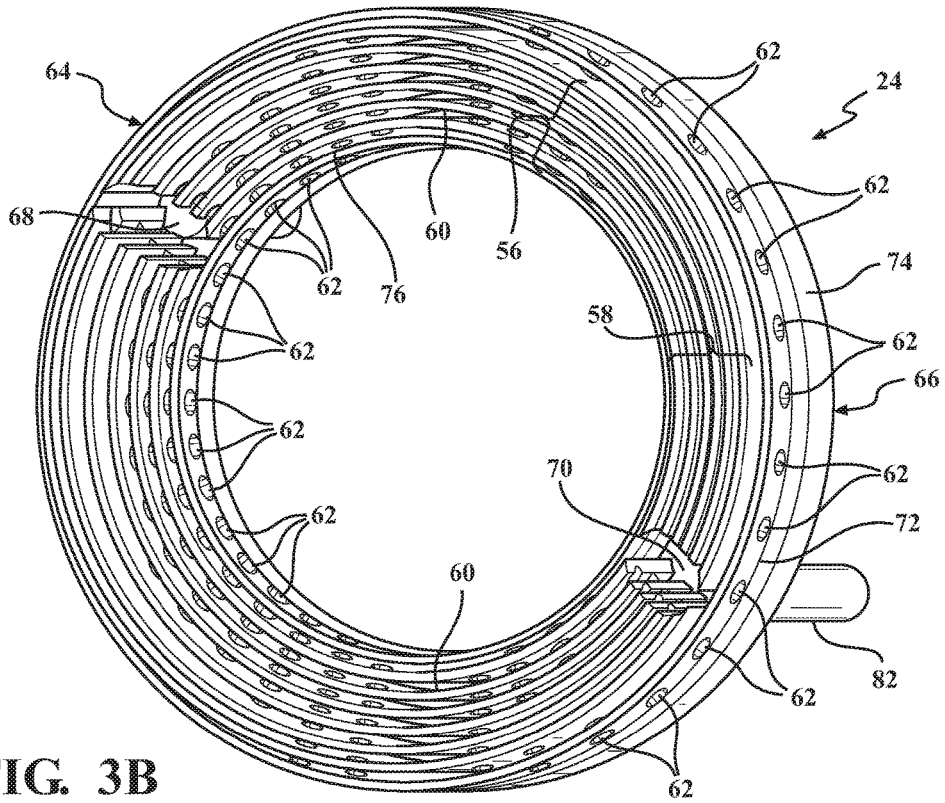
FIG. 3B is top perspective view of the radiator.
Figure 3C:
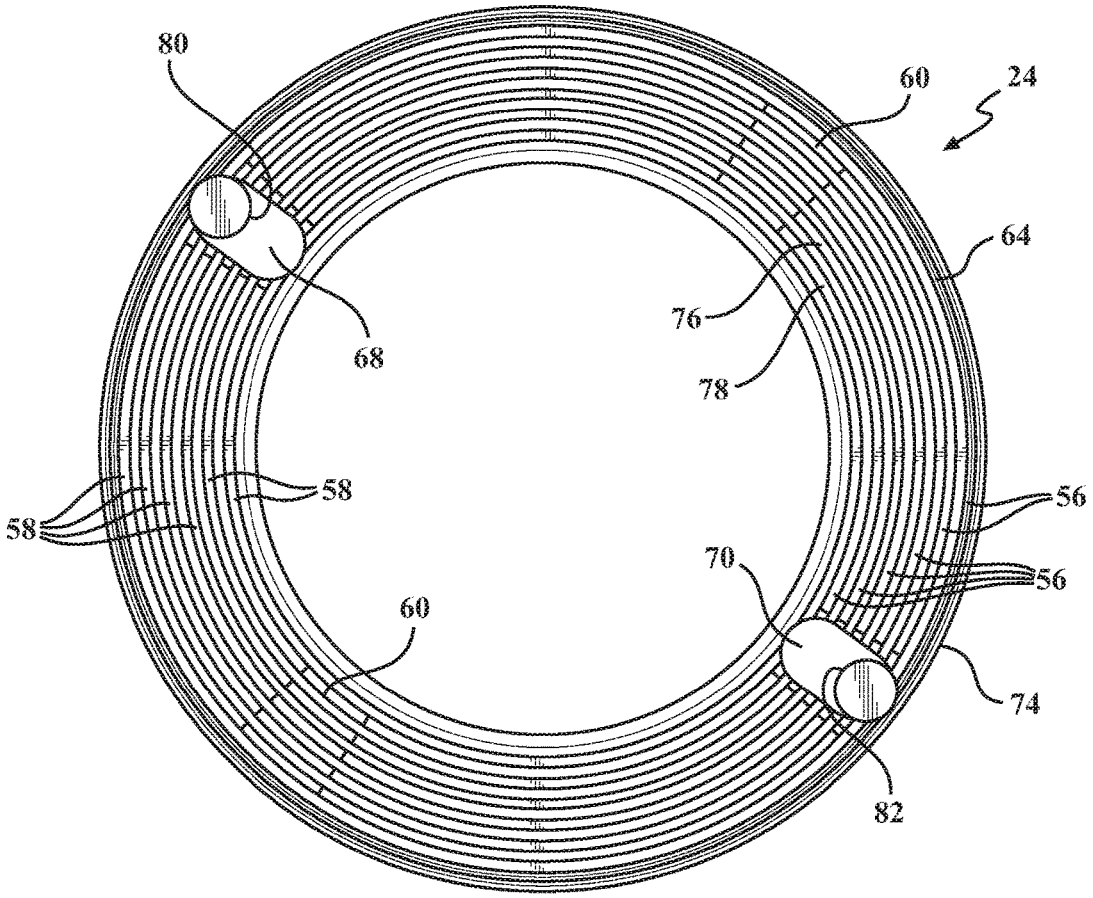
FIG. 3C is a top view of the radiator.

The radiator 24 is constructed having an open cell structure, thereby allowing oil to enter the cooling gallery 22 via the oil inlet 26, circulate through the radiator 24 while directly contacting surfaces of the upper and lower parts 28, 30, and then exit the cooling gallery 22 via the oil outlet 29. The open cell structure of the radiator 24 is provided at least in part by a plurality fins 56 (identified in FIGS. 3B and 3C for convenience) extending annularly around the cooling gallery 22. The annular fins 56 are shown as being spaced radially from one another by voids, also referred to as gaps 58 (identified in FIGS. 3B and 3C for convenience) extending annularly around the cooling gallery 22. The annular gaps 58 are initially filed with air, and the oil is permitted to flow circumferentially freely between the fins 56 within the annular gaps 58. The annular fins 56 can be spaced in concentric relation with one another, wherein the separate fins 56 are preferably connected to one another via radially extending joint members, also referred to as ribs 60, to join the fins 56 in a one-piece assembly, thereby enhancing assembly of the radiator 24 into the cooling gallery 22. To further facilitate the uniform flow of oil through the entirety of the radiator 24, a plurality of openings 62 can be formed through the annular fins 56 to allow oil to flow freely radially between adjacent annular gaps 58 and radially through the annular fins 56. The openings 62 can be arranged in any desired pattern, and are shown as being configured in radial alignment with one another.

The radiator 24 has an upper face or surface 64 facing the undercrown surface 18 and a lower face or surface 66 facing the floor 27 of the cooling gallery 22. The upper surface 64 can be configured to substantially conform to the shape of an upper surface, i.e. undercrown surface 18, such that the upper surface 64 contacts and follows the contour of the undercrown surface 18 of the cooling gallery 22. The lower surface 66 can be configured to conform to the floor 27 of the cooling gallery 22 such that the lower surface 66 contacts and follows the contour of the floor 27. As such, the fins 56 are optimally configured to conduct heat from the surrounding structure of the piston body 12.

The radiator 24 has an inlet 68 aligned with and registered in fluid communication with the oil inlet 26 opening in the floor 27 of the cooling gallery 22 and an outlet 70 aligned with and registered with the outlet 29 in the floor 27 of the cooling gallery 22. Further yet, the radiator 24 can include an annular groove 72 formed in an outer cylindrical wall 74, wherein the radiator 24 is located at least in part within the cooling gallery 24 by the annular flashing extending radially inwardly from the second bond joint 38 formed between the outer ribs 40, 42. It should be recognized the flashing, i.e. flash material, formed by the first bond joint 32 is also received without interference within an annular groove or recess 76 in a radially inwardly facing inner surface 78 of the radiator 24.

In accordance with another aspect of the invention, a method of constructing the piston 10 for an internal combustion engine is provided. The method includes providing the upper and lower parts 28, 30 of the piston body 12, with the upper part 28 having the upper combustion surface 16 configured for direct exposure to combustion gases within the cylinder bore and having the annular, toroid-shaped upper portion of the annular cooling gallery 22 and the lower part 30 having the annular, toroid-shaped lower portion of the cooling gallery 22. Then, the method includes disposing the annular radiator 24, as described above, between the upper and lower parts 28, 30, and then fixing the upper part 28 to the lower part 30 with the radiator 24 being enclosed with the substantially closed, annular cooling gallery 22. The method can further include disposing at least one, and shown as a pair of locating features 80, 82 of the radiator 24 in at least one of the oil inlet 26 and the oil outlet 29 in the floor 27 of the cooling gallery 22 prior to fixing the upper part 28 to the lower part 30. The locating features 80, 82 can be solid members intended for removal after assembly, or they can be tubular members that can remain in place, or be partially removed after assembly, such as in a conventional machining operation, by way of example and without limitation. Then, upon disposing the radiator 24 in the cooling gallery portion of the lower part 30, the upper part 28 can be brought into fixed position with the lower part 30, such as in the aforementioned friction welding process, whereupon the flashing is received in the respective grooves 72, 76 to fix the radiator in position with the cooling gallery 22. Further, any debris created in the welding process can be contained within the annular grooves 72, 76, thereby preventing the debris from entering the remaining portion of the cooling gallery 22. Then, if needed or desired, the locating features can be removed or partially machined.

Obviously, many modifications and variations of the present invention are possible in light of the above teachings. It is, therefore, to be understood that within the scope of the appended claims, the invention may be practiced otherwise than as specifically described.

What is claimed is:

1. A piston for an internal combustion engine, comprising:

a piston body including an upper part presenting an upper combustion surface and an undercrown surface beneath said upper combustion surface;

said piston body including a cooling gallery extending around said piston body beneath said undercrown surface;

a radiator disposed in said cooling gallery; and said radiator including a plurality of fins extending annularly around said cooling gallery and spaced from one another by gaps extending annularly around said cooling gallery, each one of said fins extending linearly from an upper surface to a lower surface, said upper surface contacting said undercrown surface and said lower surface contacting a floor of said cooling gallery.

2. The piston of claim 1, wherein said radiator is constructed from aluminum, copper, or steel.

3. The piston of claim 1, wherein said fins of said radiator are spaced from one another radially by said gaps.

4. The piston of claim 1, wherein said fins are disposed in concentric relation with one another.

5. The piston of claim 1, wherein said fins are connected to one another via radially extending ribs.

6. The piston of claim 1, wherein said fins include openings in radial alignment with one another for allowing oil to flow radially between said gaps and radially through said fins.

7. The piston of claim 1, wherein said radiator is constructed as a single piece of material.

8. The piston of claim 1, wherein said radiator is constructed of a plurality of separate pieces of material.

9. The piston of claim 1, wherein said upper surface of said fins conform to a shape of said undercrown surface, and said lower surface of said fins conform to a shape of said floor of said cooling gallery.

10. The piston of claim 1, radiator includes an inlet aligned with an oil inlet in said floor of said cooling gallery, and said radiator includes an outlet aligned with an oil outlet in said floor of said cooling gallery.

11. The piston of claim of 1, wherein said piston body includes a lower part extending from said upper part, said upper part includes an upper inner rib dependent from said undercrown surface and an upper outer rib spaced from said upper inner rib, said lower part includes a lower inner rib extending upwardly from said floor and a lower outer rib spaced from said lower inner rib, a first bond joint joins said inner ribs to one another, a second bond joint joins said outer ribs to one another, flash material extends radially into said cooling gallery from said first bond joint, flash material extends radially into said cooling gallery from said second bond joint, said radiator includes an outer cylindrical wall with an outer annular groove formed therein, said flash material from said second bond joint extends radially into said outer annular groove of said radiator, said radiator includes a radially inwardly facing inner surface with an inner annular groove formed therein, and said flash material from said first bond joint extends radially into said inner annular groove of said radiator.

12. The piston of claim 1, wherein said cooling gallery is substantially closed and extends annularly around said piston body.

13. The piston of claim 1, wherein said piston body includes a lower part extending from said upper part; said upper part includes an upper inner rib dependent from said undercrown surface and an upper outer rib spaced from said upper inner rib; said lower part includes a lower inner rib extending upwardly from said floor and a lower outer rib spaced from said lower inner rib; said lower part includes said floor extending between said lower ribs; and said upper ribs, said lower ribs, said undercrown surface, and said floor present said cooling gallery therebetween.

14. The piston of claim 1, wherein said piston body is formed of steel;

said piston body extends along a central longitudinal axis;

said piston body includes a lower part extending along said central axis from said upper part;

said lower part is fixed to said upper part;

said lower part and said upper part present said cooling gallery therebetween;

said upper part presents an upper portion of said cooling gallery and said lower part presents a lower portion of said cooling gallery;

said undercrown surface is located directly and axially beneath said upper combustion surface;

said upper combustion surface has a recessed combustion bowl;

said piston body has a ring belt depending from said upper combustion surface;

said ring belt is configured for receipt of at least one piston ring;

said cooling gallery is substantially closed and extends annularly around said piston body;

said cooling gallery is disposed radially inwardly of and in substantial radial alignment with said ring belt;

said upper part includes an upper inner rib dependent from said undercrown surface and an upper outer rib spaced from said upper inner rib and forming a portion of said ring belt;

said lower part includes a lower inner rib extending upwardly from said floor and a lower outer rib spaced from said lower inner rib and forming a portion of said ring belt;

said ribs, said undercrown surface, and said floor present said cooling gallery therebetween;

a first bond joint joins said inner ribs to one another;

a second bond joint extends through said ring belt to join said outer ribs to one another;

flash material extends radially into said cooling gallery from said first bond joint;

flash material extends radially into said cooling gallery from said second bond joint;

said floor of said lower part includes an oil inlet for allowing cooling oil to enter said cooling gallery and an oil outlet for allowing cooling oil to exit said cooling gallery;

said lower part includes a pair of pin bosses having laterally spaced pin bores coaxially aligned along a pin bore axis that extends generally transverse to said central longitudinal axis;

said pin bosses are joined to laterally spaced skirt portions via strut portions;

said skirt portions are diametrically spaced from one another across opposite sides of said pin bore axis and have convex outer surfaces;

said radiator is constructed from a piece of thermally conductive metal material and separate from the steel of said piston body;

said thermally conductive metal material of said radiator includes aluminum, copper, or steel;

said fins of said radiator are spaced from one another radially by said gaps;

said fins are disposed in concentric relation with one another;

said fins are connected to one another via radially extending ribs;

said fins include openings in radial alignment with one another for allowing oil to flow radially between said gaps and radially through said fins;

said radiator presents an upper surface facing said undercrown surface and a lower surface facing said floor of said cooling gallery;

said upper surface of said fins of said radiator conform to a shape of said undercrown surface;

said lower surface of said fins of said radiator conform to a shape of said floor of said cooling gallery;

said radiator includes an inlet aligned with said oil inlet in said floor of said cooling gallery and an outlet aligned with said oil outlet in said floor of said cooling gallery;

said radiator includes an outer cylindrical wall with an outer annular groove formed therein;

said flash material from said second bond joint extends radially into said outer annular groove of said radiator;

said radiator includes a radially inwardly facing inner surface with an inner annular groove formed therein; and said flash material from said first bond joint extends radially into said inner annular groove of said radiator.

15. A method of manufacturing a piston, comprising the steps of:

providing a piston body including an upper part and a lower part, the upper part having an upper combustion surface and an undercrown surface beneath the upper combustion surface, and the piston body including a cooling gallery extending annularly around the piston body beneath the undercrown surface; and disposing a radiator in the cooling gallery, the radiator including a plurality of fins extending annularly around the cooling gallery and spaced from one another by air gaps extending annularly around the cooling gallery, and each one of the fins extending linearly from an upper surface to a lower surface, the upper surface contacting the undercrown surface and the lower surface contacting a floor of the cooling gallery.

16. The method of claim 15, wherein the step of disposing the radiator in the cooling gallery includes disposing the radiator between the upper part and the lower part, and fixing the upper part and the lower part to form the cooling gallery containing the radiator therebetween.

17. The method of claim 16 further including disposing at least one locating feature of the radiator in at least one of an oil inlet and an oil outlet in a floor of the cooling gallery prior to fixing the upper part to the lower part.

18. The method of claim 15, wherein the step of providing the piston body includes welding the upper part and the lower part.

19. The method of claim 15, wherein the fins of the radiator are spaced from one another radially by the gaps.

20. The method of claim 15, wherein the fins are disposed in concentric relation with one another.

* * * * *